United States Patent [19]

Morishita

[11] 4,257,236

[45] Mar. 24, 1981

[54] LIQUID ATOMIZING DEVICE

[75] Inventor: Teru Morishita, Shizuoka, Japan

[73] Assignee: Toyota Jidosha Kogyo Kabushiki Kaisha, Toyota, Japan

[21] Appl. No.: 21,248

[22] Filed: Mar. 16, 1979

[30] Foreign Application Priority Data

Oct. 30, 1978 [JP] Japan ..... 53-149191[U]

[51] Int. Cl.[3] ..... F02C 7/22

[52] U.S. Cl. ..... 60/745

[58] Field of Search ..... 60/745

[56] References Cited

U.S. PATENT DOCUMENTS

| | | | |
|---|---|---|---|
| 2,547,959 | 4/1951 | Miller | 60/745 |
| 2,720,750 | 10/1955 | Schelp | 60/745 |
| 3,102,393 | 9/1963 | Clare | 60/745 |
| 3,921,393 | 11/1975 | Bracken | 60/745 |
| 3,983,694 | 10/1976 | Bracken | 60/745 |
| 4,086,760 | 5/1978 | Chute | 60/745 |

*Primary Examiner*—Robert E. Garrett

*Attorney, Agent, or Firm*—Oblon, Fisher, Spivak, McClelland & Maier

[57] ABSTRACT

A liquid atomizing device comprises a nozzle emitting the liquid to be atomized, and a hollow cylindrical atomizing member secured at one end to a rotary shaft coaxially therewith for rotation about its own axis. The atomizing member has a circular cylindrical inner surface coaxially encircling the rotary shaft. According to one embodiment, the inner surface has a uniform diameter, while it is of dual diameter according to another embodiment. The nozzle faces the inner surface of the atomizing member to direct a jet of liquid thereagainst. The atomizing member is provided at another end thereof, which is open and defines an outlet for the atomizing member, with a plurality of radially inwardly projecting arcuate rims which are circumferentially equally spaced apart from one another to define an arcuate recess between each adjoining pair of rims. Those recesses define a path for a spray of atomized liquid leaving the inner surface of the atomizing member centrifugally during the rotation of the atomizing member.

8 Claims, 8 Drawing Figures

LIQUID ATOMIZING DEVICE

BACKGROUND OF THE INVENTION

1. Field of the Invention

This invention relates to a liquid atomizing device and more particularly, to a device for atomizing liquid fuel in a gas turbine. It is a rotary device which atomizes liquid centrifugally.

2. Description of the Prior Art

The prior art of which the inventor is aware as being relevant to this invention includes a rotary liquid atomizing device having a disc secured to a rotary shaft for rotation therewith, and a stationary nozzle which emits the liquid to be atomized. The liquid emitted from the nozzle strikes against the disc and by virtue of the centrifugal force created by the rotation of the disc, the liquid is scattered in atomized form as it leaves the disc. Centrifugal atomization, however, requires to a certain extent adherence of liquid to the surface of the rotating disc. If the speed of rotation of the disc in the device under discussion is higher than a certain level, the liquid emitted from the nozzle is splashed by the disc without properly adhering thereto, so that little or no atomization can be accomplished. It is found that effective atomization can be obtained only when the speed of rotation of the disc is not greater than 10 meters per second, and that if it is in excess of 20 meters per second, no atomization is possible.

Another device known in the art comprises a rotary hollow cylinder having an open end through which the liquid to be atomized is injected into the cylinder. The cylindrical wall of the cylinder is provided therethrough with a plurality of outlet holes through which, as the cylinder rotates, the liquid introduced into the cylinder is centrifugally emitted to form a spray of atomized liquid. This device is, however, notorious for its inability to produce a satisfactorily fine spray of atomized liquid, however small the outlet holes may be made in diameter. This is experimentally demonstrated as the results will hereinafter be discussed with reference to FIG. 5 of the accompanying drawings.

There is also known a liquid atomizing device having a similar hollow rotary shaft provided with a swirl nozzle through which the liquid introduced into the hollow interior of the shaft is centrifugally emitted in atomized form during the rotation of the shaft. The wall of the hollow shaft is pierced with a hole which is perpendicular to the axial bore of the shaft, and in which the swirl nozzle is mounted. This device permits atomization of liquid to finer particles than those obtained by the device described in the immediately preceding paragraph, but nevertheless, fails to produce a satisfactorily fine spray of atomized liquid. As the swirl nozzle is subjected to a large centrifugal force during the rotation of the shaft, it can unintentionally be disengaged from the shaft unless it is very firmly secured to the shaft.

SUMMARY OF THE INVENTION

It is an object of this invention to provide a liquid atomizing device which can produce a satisfactorily fine spray of atomized liquid.

It is another object of this invention to provide a liquid atomizing device which is easily applicable to a liquid fuel fired gas turbine to provide it with a high thermal efficiency and a uniform temperature distribution in its combustion chamber without being influenced in any way by the high temperature prevailing therein and without interfering with the idling operation of the gas turbine.

This invention provides a liquid atomizing device comprising a nozzle emitting the liquid to be atomized, and a hollow cylindrical atomizing member adapted at one end for attachment to a rotary shaft coaxially therewith for rotation about its own axis. The atomizing member has a cylindrical inner surface encircling the nozzle. The nozzle has an outlet so oriented as to emit a jet of liquid at right angles to the inner surface of the atomizing member. The liquid emitted from the nozzle adheres to the inner surface of the atomizing member and forms a thin layer of liquid thereon, which will eventually be sprayed centrifugally. The atomizing member is provided at another end thereof with a plurality of arcuate rims radially inwardly projecting from the other end of the atomizing member. The rims are equidistantly spaced apart from one another to define an arcuate recess between each adjoining pair of the rims. The recesses defined by the rims define a path for a spray of atomized liquid leaving the inner surface of the atomizing member centrifugally during the rotation of the atomizing member.

DESCRIPTION OF THE PREFERRED EMBODIMENTS

Figure 1:
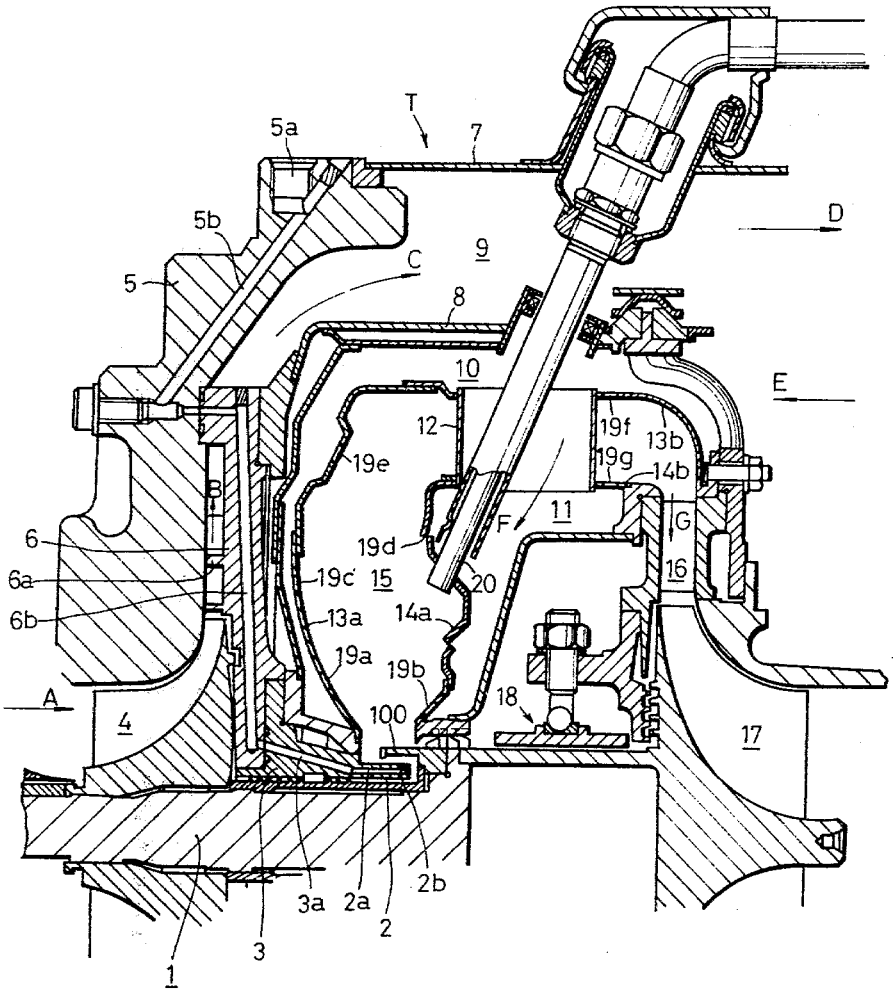
FIG. 1 is a fragmentary longitudinal sectional view of a gas turbine in which a liquid atomizing device embodying this invention is employed.
Figure 2:
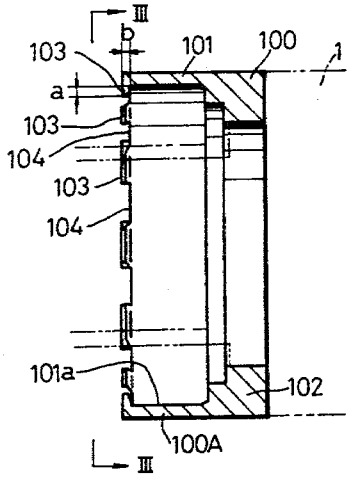
FIG. 2 is a longitudinal sectional view of the liquid atomizing device fragmentarily shown in FIG. 1.
Figure 3:
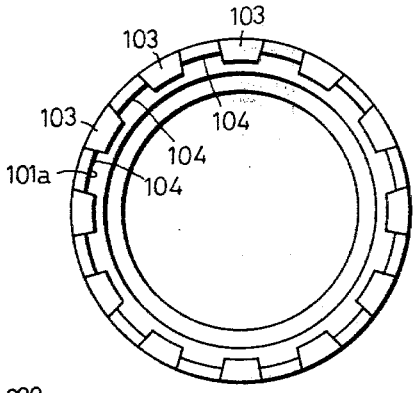
FIG. 3 is a front elevational view of the liquid atomizing device as looked at in the direction of lines III—III of FIG. 2.
Figure 4:
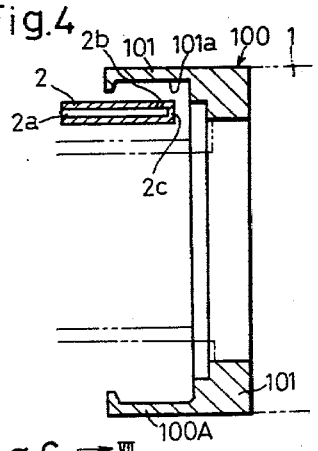
FIG. 4 is a longitudinal sectional view of the liquid atomizing device of FIG. 2 shown in its complete form with a nozzle.

Referring to FIGS. 2 through 4 of the drawings, there is shown a liquid atomizing device 100 embodying this invention and which is advantageously employed in a liquid fuel fired gas turbine T as shown in FIG. 1. The liquid atomizing device 100 comprises a hollow cylindrical atomizing member 100A having a uniform outside diameter along its entire length. The atomizing member 100A comprises a cylindrical body 101 having a uniform wall thickness terminating inwardly of one end of the atomizing member 100A which is formed with a radially inwardly projecting double annular shoulder 102. The shoulder 102 is provided for the purpose of mounting the atomizing member 100A to a rotary shaft which is, in the structure herein described, a rotary shaft 1 in the gas turbine T as shown in FIG. 1. The atomizing member 100A is, thus, secured to the rotary shaft 1 and is capable of rotation about the rotary shaft 1 upon rotation of the latter about its own axis. The cylindrical body 101 has a cylindrical inner surface 101*a* having an inner edge on the internal extremity of the shoulder 102. The cylindrical inner surface 101*a* is coaxial with the rotary shaft 1.

The cylindrical inner surface 101*a* terminates in an outer edge at the other end of the atomizing member 100A. The other end of the atomizing member 100A is provided with a plurality of radially inwardly projecting arcuate rims 103 each having a radial width a of approximately 0.5 to 1.5 mm projecting radially inwardly from the cylindrical inner surface 101*a*. All the rims 103 have an equal arcuate length. The rims 103 are spaced apart equidistantly from one another to define an arcuate recess 104 between each adjoining pair of the rims 103 as is best shown in FIG. 3. Each recess 104 is on the cylindrical inner surface 101*a* as shown in FIG. 3. Each rim 103 projects longitudinally of the atomizing member 100A beyond the outer edge of the cylindrical inner surface 101*a* by a dimension indicated at b in FIG. 2 which is in other words the thickness of the rim 103.

The liquid atomizing device of this invention further includes a nozzle emitting the liquid to be atomized, which is, in the construction herein described, a fuel injection nozzle 2 in the gas turbine T as shown in FIG. 1. The nozzle 2 extends into the cylindrical body 101 in parallel to the rotary shaft 1 as shown in FIGS. 1 and 4. The nozzle 2 has an axial bore 2*a* defining a path for liquid fuel, and a closed free end 2*c* surrounded by the cylindrical inner surface 101*a* of the atomizing member 100A. The nozzle 2, which is of the tubular shape, is pierced with an outlet hole 2*b* through its tubular side wall in the vicinity of its closed end 2*c*. The outlet hole 2*b* has an axis directed substantially at right angles to the cylindrical inner surface 101*a* of the atomizing member 100A. The cylindrical inner surface 101*a* of the atomizing member 100A coaxially encircles the rotary shaft 1.

The liquid fuel to be atomized is emitted through the outlet hole 2*b* of the nozzle 2 against the cylindrical inner surface 101*a* of the atomizing member 100A at a predetermined level of pressure when the rotary shaft 1 is rotating at a high speed. By virtue of the centrifugal force generated by the atomizing member 100A which rotates with the rotary shaft 1 at a high speed, the liquid fuel emitted from the nozzle 2 spreads over the cylindrical inner surface 101*a* of the cylindrical body 101 without being splashed by the cylindrical inner surface 101*a*. Due to its viscosity, gas existing in the cylindrical body 101 forms in close proximity to the cylindrical inner surface 101*a* a thin boundary layer of gas flowing in the direction of rotation of the cylindrical body 101. The liquid centrifugally spreading over the cylindrical inner surface 101*a* forms a thin layer of liquid, which is caused to rotate with gas flowing in the boundary gaseous layer and driven by a stronger centrifugal force against the cylindrical inner surface 101*a* to spread thereon in a thinner layer. As the speed of rotation of the cylindrical body 101 increases, a very large centrifugal force acts on the liquid and spreads it in a very thin layer on the cylindrical inner surface 101*a*. According to the present application of this invention to the gas turbine T, the cylindrical body 101 may be rotated at a speed of approximately 200 meters per second.

The liquid emitted from the nozzle 2 does not only spread around the circumference of the cylindrical inner surface 101*a*, but also longitudinally thereof toward the outer end of the cylindrical body 101. The liquid flowing longitudinally of the cylindrical body 101 is stopped by the rims 103 at its outer end and caused to spread more uniformly circumferentially of the cylindrical inner surface 101*a*, while it is eventually discharged through the recesses 104 between the rims 103. When the liquid is discharged through the recesses 104, therefore, it is discharged uniformly in the form of very thin films or fine threads under the action of an extremely large centrifugal force. The liquid leaving the atomizing member 100A is exposed to the large shearing force of ambient gaseous matter and, thus, provides a uniformly distributed spray of extremely small liquid particles.

In any rotary liquid atomizing device of the sort under discussion, it is generally the kinetic energy generated by the centrifugal force acting on the liquid that contributes to atomization of the liquid. Production of a satisfactorily fine spray of atomized liquid requires effective utilization of this kinetic energy. In order to most effectively utilize the kinetic energy obtained by the liquid, it is necessary to make the ratio of the surface area of liquid to its weight as large as possible before the liquid is split into drops. This requirement is fully satisfied by the liquid atomizing device of this invention in which the liquid to be atomized is centrifugally spread in a very thin layer on the cylindrical inner surface 101*a* of the cylindrical body 101 and discharged through the recesses 104 between the rims 103 in the form of extremely thin sheets or fine filaments.

Figure 5:
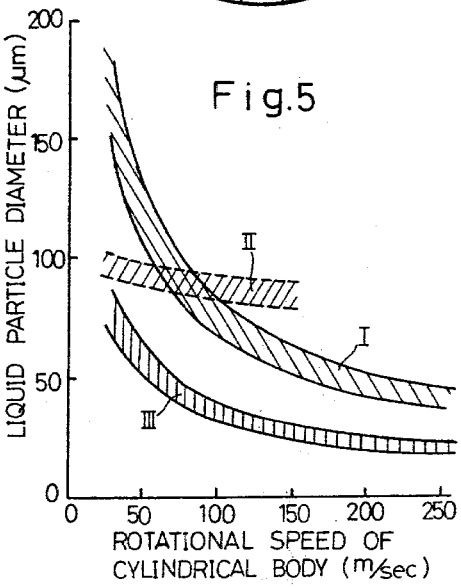
FIG. 5 is a chart illustrating a characteristic feature of the liquid atomizing device embodying this invention in comparison with those of the conventional liquid atomizing devices.

FIG. 5 is a chart showing the experimental results demonstrating a characteristic feature of a spray of atomized liquid obtained by the liquid atomizing device 100 of this invention, in contrast to the results of liquid atomization by a couple of conventional devices. In this chart, the axis of abscissa represents the speed of rotation of the cylindrical body 101 or equivalent in meters per second, while the axis of ordinate indicates the diameter ($\mu$m) of the liquid particles obtained. The mean diameter of liquid particles is shown in terms of the Sauter mean diameter (volume-to-surface mean diameter). Water was used in the experiments as the liquid to be atomized. It will be understood that fuel oil can be more finely atomized to the extent that its particle size is 60% to 70% as large as that of water. Graph I in FIG. 5 represents the result of the test conducted with the conventional liquid atomizing device having a rotary hollow cylinder provided with a plurality of outlet holes as described on page 1, line 26 to page 2, line 9 of this specification. The diameter of the outlet holes was in the range of 0.2 mm to 2.0 mm. Graph II shows the result of the test on the conventional device provided with a swirl nozzle as described on page 2, lines 10 to 22 of this specification. The diameter of the swirl nozzle was 0.3 mm. Graph III illustrates the results obtained by the liquid atomizing device 100 of this invention. It is evident from FIG. 5 that however small the outlet holes may be made in diameter, the conventional device as represented by Graph I can only produce considerably coarser liquid particles than those obtained by the device of this invention. FIG. 5 is also self-explanatory in that the swirl nozzle is far from satisfactory as compared with the device of this invention.

According to this invention, it is very significant that liquid centrifugally formed into an extremely thin sheet does not leave the hollow cylindrical atomizing member along its entire circular edge, but is discharged only through the recesses provided between the rims. This is true even where the device of this invention is used in a high temperature environment to handle a very small quantity of liquid. This feature is advantageously utilized particularly when the device of this invention is applied, for example, to a small-sized gas turbine having a heat exchanger of high efficiency. Such a small-sized gas turbine is supplied with only a small quantity of fuel, particularly during its idling operation, and the high efficiency heat exchanger provided on the gas turbine elevates to a considerably high degree the temperature of the air introduced into the combustion chamber through the heat exchanger.

Referring to the gas turbine T shown in FIG. 1, the rotary shaft 1 on which the atomizing member 100A is mounted is rotated by a turbine rotor 17. The rotation of the rotary shaft 1 causes a compressor rotor 4 to rotate, so that air is drawn into the compressor rotor 4 as an arrowline A indicates in FIG. 1. A velocity energy which is imparted by the compressor rotor 4 to the air flowing thereinto drives the air, as an arrowline B shows, into vanes 6*a* of a diffuser 6, in which the speed of the air is reduced and its pressure increased. The air leaves the diffuser 6 and moves forward into an annular air passage 9 between an outer housing 7 and an inner housing 8 as indicated by an arrowline C. The air, then, flows in the direction of an arrowline D into a heat exchanger (not shown) to be heated therein. The air then leaving the heat exchanger flows in the direction of an arrowline E into an air chamber 10, and also into another air chamber 11 through an air duct 12 as shown by an arrowline F.

Liquid fuel, which is introduced into a fuel inlet 5*a* provided in a front housing 5, is delivered into the axial bore 2*a* of the nozzle 2 through a fuel passage 5*b* in the front housing 5, a fuel passage 6*b* in the diffuser 6 and a fuel passage 3*a* in a retainer 3. The fuel is discharged through the outlet hole 2*b* of the nozzle 2 against the cylindrical inner surface 101*a* of the atomizing member 100A. The fuel spreads in a very thin layer on the cylindrical inner surface 101*a* and forms a spray of fine particles uniformly distributed circumferentially of the atomizing member 100A when leaving the atomizing member 100A under the action of the centrifugal force and entering the combustion chamber 15 defined by casings 13*a* and 14*a*. The casings 13*a* and 14*a* are provided with holes 19*a*, 19*b*, 19*c*, 19*d* and 19*e* through which air is introduced from the air chambers 10 and 11 into the combustion chamber 15. This air is mixed with the fuel in the combustion chamber 15. The fuel-air mixture is ignited by an ignition plug 20 and burns continuously in the combustion chamber 15. The product of combustion flows through a passage defined by casings 13*b* and 14*b* having holes 19*f* and 19*g* which fluidly communicates the passage with the air chambers 10 and 11. Air is introduced from the air chambers 10 and 11 into the passage and mixes with the combustion product therein to lower its temperature to an appropriate level. The combustion product, then, passes through a turbine nozzle 16 as indicated by an arrowline G and impinges against the turbine rotor 17 to rotate it. An air bearing 18 shown in FIG. 1 and a ball bearing not shown support the rotary shaft 1 rotatably at a high speed.

Figure 6:
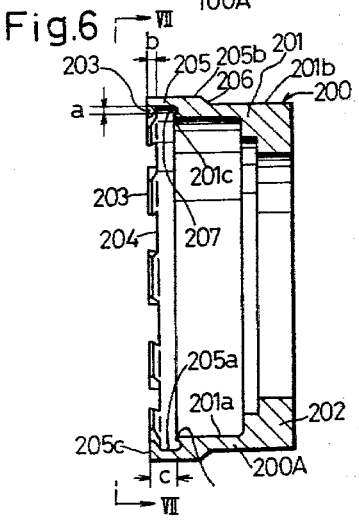
FIG. 6 is a longitudinal sectional view of another liquid atomizing device embodying this invention.
Figure 7:
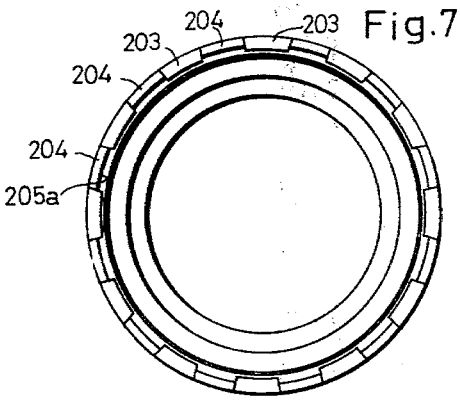
FIG. 7 is a front elevational view of the liquid atomizing device as looked at in the direction of lines VII—VII of FIG. 6.

FIGS. 6 and 7 show another liquid atomizing device 200 embodying this invention. The liquid atomizing device 200 includes a hollow cylindrical atomizing member 200A provided at one end with a radially inwardly projecting double annular shoulder 202 which secures the atomizing member 200A to a rotary shaft, so that the atomizing member 200A may be rotated about its own axis upon rotation of the rotary shaft. This rotary shaft may be the rotary shaft 1 of the gas turbine T shown in FIG. 1. The atomizing member 200A has a double cylindrical inner surface between the shoulder 202 and the other end of the atomizing member 200A. The atomizing member 200A includes a hollow cylindrical body 201 having a uniform inside diameter terminating at one end in the shoulder 202. This uniform inside diameter defines a first cylindrical inner surface 201*a* of the atomizing member 200A. The atomizing member 200A has an integral hollow cylindrical extension 205 which coaxially extends from the cylindrical body 201 and which is greater in inside diameter than the cylindrical body 201. The cylindrical extension 205 has a cylindrical inner surface which defines a second cylindrical inner surface 205*a* of the atomizing member 200A. The second cylindrical inner surface 205*a* is coaxial with the first cylindrical inner surface 201*a* and has a larger diameter than the latter. The cylindrical body 201 has a cylindrical outer surface 201*b*. The cylindrical extension 205 has a cylindrical outer surface 205*b* which is connected with the cylindrical outer surface 201*b* of the cylindrical body 201 by an annular shoulder 206. The first and second cylindrical inner surfaces 201*a* and 205*a* are coaxial with the rotary shaft 1 of the gas turbine T when the atomizing member 200A is mounted on the rotary shaft 1. The first cylindrical inner surface 201*a* terminates at another end 201*c* in a radially outwardly extending annular shoulder 207 having an outer circumference which is contiguous to the second cylindrical inner surface 205*a* as is clearly shown in FIG. 6.

The cylindrical extension 205 is provided along its outer end with a plurality of circumferentially equally spaced, radially inwardly projecting arcuate rims 203. The rims 203 have a radial width radially inwardly projecting from the second cylindrical inner surface 205*a* as indicated at a in FIG. 6. The radial width a of each rim 203 is usually approximately 0.5 mm to 1.5 mm. Each adjoining pair of the rims 203 defines an arcuate recess 204 therebetween. Each recess 204 is on the second cylindrical inner surface 205*a* as best shown in FIG. 7. Each recess 204 has a longitudinal depth, which is in fact the thickness of each rim 203, as indicated at b in FIG. 6. The longitudinal dimension of the cylindrical extension 205 as measured between the outer end of the first cylindrical inner surface 201*a* and the outer end 205*c* of the cylindrical extension 205, which is indicated at c in FIG. 6, is satisfactory if it is greater than the dimension b to some extent, usually by 1.5 mm to 3.0 mm. The liquid atomizing device 200 herein described with reference to FIGS. 6 and 7 further includes a nozzle emitting the liquid to be atomized, which may be of the type shown at 2 in FIGS. 1 and 4. No detailed description of such a nozzle would be necessary any more.

In the operation of the device shown in FIGS. 6 and 7, the liquid emitted from the nozzle spreads uniformly in a very thin layer on the first cylindrical inner surface 201*a* of the atomizing member 200A, exactly as has hereinbefore been described with reference to the device of FIGS. 1 to 4. With reference to the device of FIG. 6, it is to be understood that the nozzle, when mounted in position, has its outlet facing the first cylindrical inner surface 201*a* substantially at right angles thereto. The liquid on the first cylindrical inner surface 201*a* is centrifugally transferred past its outer end 201*c* onto the second cylindrical inner surface 205*a* in the form of very thin films or filaments. This transfer is similar in effect to discharge of liquid through an infinitely large number of nozzles, so that liquid is deposited in a thinner layer of more uniform thickness on the second cylindrical inner surface 205*a*. According to the device of FIGS. 6 and 7, therefore, the liquid which leaves the second cylindrical inner surface 205*a* through the recesses 204 forms a radially outwardly spreading spray of liquid in the form of thinner films or filaments than those available with the device of FIGS. 1 to 4, so that by virtue of the large shearing force of the ambient gaseous material, liquid can be divided into finer particles and distributed more uniformly across the space which is to be fed with atomized liquid, than can be accomplished by the device of FIGS. 1 to 4.

Figure 8:
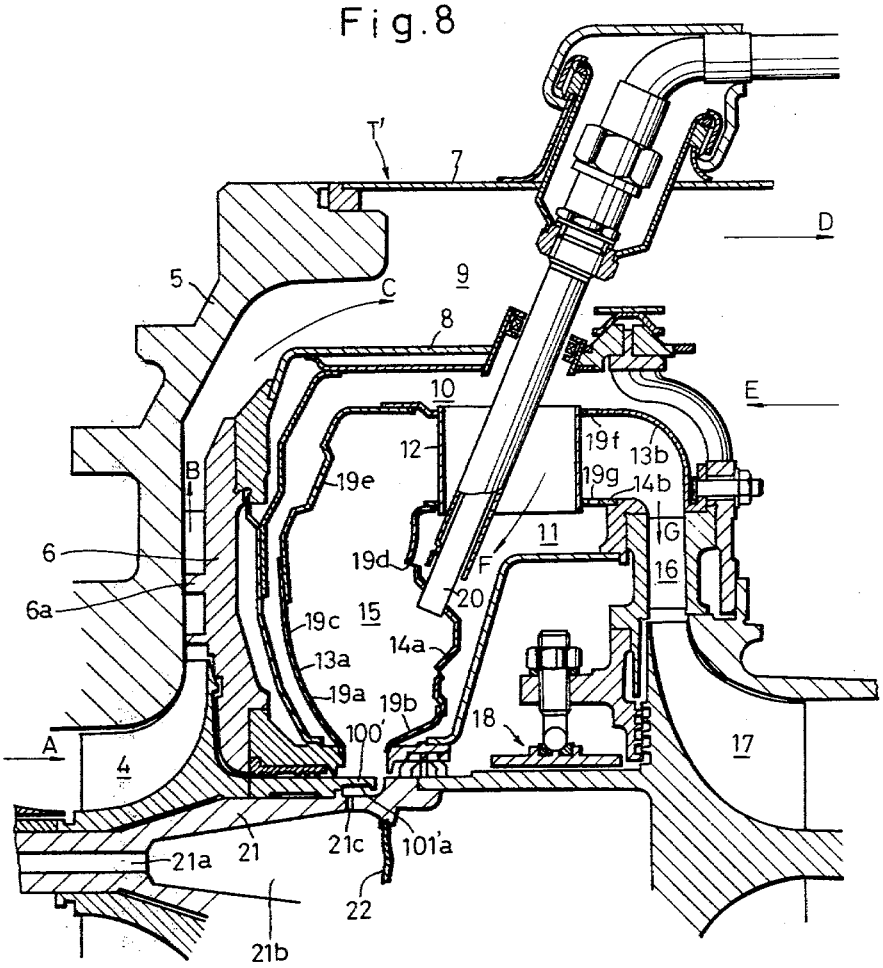
FIG. 8 is a fragmentary longitudinal sectional view of a gas turbine in which a different liquid atomizing device embodying this invention is employed.

FIG. 8 illustrates a different liquid atomizing device 100' embodying this invention as applied to a different liquid fuel fired gas turbine T'. The gas turbine T' has a hollow rotary shaft 21 having an axial bore 21*a* which enlarges itself into a larger hollow internal space 21*b* closed by a wall 22. The rotary shaft 21 serves in the context of this invention as a nozzle which emits the liquid fuel to be atomized. The axial bore 21*a* and the hollow internal space 21*b* define a path for the fuel to be emitted. The rotary shaft 21 is pierced through its sidewall with an outlet hole 21*c* through which fuel is discharged from the rotary shaft 21. The liquid atomizing device 100' includes a hollow cylindrical atomizing member which is essentially of the same construction as that shown at 100 in FIGS. 1 to 4, though it is differently positioned in FIG. 8 with respect to the rotary shaft. The atomizing member coaxially encircles the rotary shaft 21 and is secured to it for rotation therewith. In the structure of FIG. 8, it will be noted that the nozzle rotates with the atomizing member at the same speed. The atomizing member includes a hollow cylindrical body having a cylindrical inner surface 101'*a* coaxially encircling the rotary shaft 21. The outlet hole 21*c* of the rotary shaft 21 has an axis directed substantially at right angles to the cylindrical inner surface 101'*a* of the atomizing member, so that a jet of fuel is emitted through the outlet hole 21*c* against the cylindrical inner surface 101'*a*. The liquid atomizing device 100' of FIG. 8 operates in accordance with the same principle or mechanism of liquid atomization as achieved by using the device of FIGS. 1 to 4. It will also be possible to employ the device of FIG. 6 in the gas turbine shown in FIG. 8.

According to this invention, the radially inwardly projecting rims provided around the outer end of the cylindrical atomizing member do not merely serve to stop liquid and urge it to flow circumferentially of the atomizing member to form a satisfactorily thin layer of liquid on its cylindrical inner surface before the liquid leaves the atomizing member. Because of the provision of the rims, liquid is only allowed to pass through certain restricted paths defined by the circumferentially spaced recesses, instead of being discharged at any point around the entire circumference of the atomizing member, when leaving the atomizing device in atomized form. This feature is significant in the sense that the liquid retained by the rims and caused to flow only through the restricted paths acts as a coolant for the outer end of the atomizing member. This is particularly true where it is desired to employ the liquid atomizing device in an environment in which it is exposed to a high temperature, while handling a relatively small quantity of liquid. A typical instance of such environment is a small-sized liquid fuel fired gas turbine having a high efficiency heat exchanger. A small gas turbine is supplied with only a small quantity of fuel, especially during its idling operation. The temperature of the combustion air supplied into the combustion chamber is raised by the heat exchanger to a considerably high level, for example, as high as 600° C. to 650° C. This air heats to a considerably high temperature the outer end of the atomizing member which is exposed in the combustion chamber of the turbine. The quantity of the fuel supplied into such a turbine is too small to cool the outer end of the atomizing member to a sufficiently low temperature if it is allowed to flow out of the atomizing member around the entire circumference thereof. Insufficient cooling results in carbonization of a part of the fuel and adhesion of the resultant carbon to the outer end of the atomizing member. The adhesion of carbon lowers the performance of the liquid atomizing device. This does not happen to the liquid atomizing device of this invention, because the rims guide the flow of fuel through the recesses therebetween, as well as along the rims, so that the fuel may cool down the outer end of the atomizing member sufficiently to prevent its overheating which would otherwise be caused by the high temperature atmosphere in the combustion chamber of the gas turbine.

While the invention has been described with reference to a few preferred embodiments thereof, it is to be understood that further modifications or variations may be easily made by a person of ordinary skill in the art of liquid atomization without departing from the spirit and scope of this invention as defined by the appended claims.

What is claimed is:

1. A liquid atomizing device comprising:

a nozzle emitting the liquid to be atomized; and a hollow cylindrical atomizing member adapted at one end for attachment to a rotary shaft coaxially therewith for rotation about its own axis, said atomizing member having a cylindrical inner surface coaxially encircling said rotary shaft;

said nozzle having an outlet having an axis directed substantially at right angles to said inner surface;

said atomizing member being provided at another end thereof, which is open and defines an outlet for said atomizing member, with a plurality of arcuate rims radially inwardly projecting from said other end of said atomizing member, said rims being circumferentially equally spaced apart from one another to define an arcuate recess between each adjoining pair of said rims, said recesses defining paths on said cylindrical inner surface for a spray of said liquid leaving said inner surface centrifugally during the rotation of said atomizing member.

2. A liquid atomizing device as set forth in claim 1, wherein said cylindrical inner surface has a uniform diameter in its entirety.

3. A liquid atomizing device as set forth in claim 1, wherein said cylindrical inner surface comprises a first cylindrical inner surface which is contiguous to said one end of said atomizing member, and a second cylindrical inner surface which is contiguous to said other end of said atomizing member and greater in diameter than said first cylindrical inner suface, said first and second cylindrical inner surfaces being connected with each other by a radially extending annular shoulder, said outlet of said nozzle facing said first cylindrical inner surface.

4. A liquid atomizing device as set forth in claim 2, wherein each of said rims has a radial width of 0.5 mm to 1.5 mm projecting radially inwardly from said cylindrical inner surface, and said cylindrical inner surface is exposed through each of said recesses.

5. A liquid atomizing device as set forth in claim 3, wherein each of said rims has a radial width of 0.5 mm to 1.5 mm projecting radially inwardly from said second cylindrical inner surface, and said second cylindrical inner surface is exposed through each of said recesses, and said rims are spaced a distance of 1.5 mm to 3.0 mm apart from said shoulder.

6. A device for atomizing liquid fuel in a gas turbine having a rotary shaft and a fuel injection nozzle extending in the vicinity of said rotary shaft in parallel thereto, said atomizing device comprising:

a hollow cylindrical atomizing member secured at one end to said rotary shaft coaxially therewith for rotation about its own axis, said one end having means for securing said atomizing member to said rotary shaft, said atomizing member having a circular cylindrical inner surface coaxially encircling said rotary shaft and extending between said securing means and another end of said atomizing member which is open and defines an outlet for said atomizing member, said atomizing member being provided with a plurality of arcuate rims radially inwardly projecting from said other end thereof, said rims being circumferentially equally spaced apart from one another to define an arcuate recess between each adjoining pair of said rims, said recesses defining paths on said cylindrical inner surface for a spray of fuel leaving said inner surface centrifugally during the rotation of said atomizing member;

said nozzle extending into said atomizing member and having an outlet having an axis directed substantially at right angles to said inner surface of said atomizing member to direct a jet of fuel against said inner surface.

7. A device for atomizing liquid fuel in a gas turbine having a rotary shaft and a fuel injection nozzle extending in parallel to said rotary shaft in the vicinity thereof, said atomizing device comprising:

a hollow cylindrical body secured at one end to said rotary shaft coaxially therewith for rotation about its own axis, said one end having means for securing said cylindrical body to said rotary shaft, said cylindrical body having a circular cylindrical inner surface coaxially encircling said rotary shaft and extending between said securing means and another end of said cylindrical body which is open and defines an outlet for said cylindrical body, said cylindrical body being formed at said other end thereof with a radially outwardly extending annular shoulder which is contiguous to said inner surface;

a hollow cylindrical extension coaxially projecting from said other end of said cylindrical body contiguously to said shoulder, said extension having a circular cylindrical inner surface coaxially encircling said rotary shaft and extending between said shoulder and an outer end of said extension which is remote from said shoulder, said inner surface of said extension being greater in diameter than said inner surface of said cylindrical body, said extension being provided with a plurality of arcuate rims radially inwardly projecting from said outer end thereof, said rims being circumferentially equally spaced apart from one another to define an arcuate recess between each adjoining pair of said rims, said recesses defining paths on said inner surface of said extension for a spray of fuel leaving said inner surface of said extension through said inner surface of said cylindrical body centrifugally during the rotation of said cylindrical body and extension;

a nozzle extending through said extension into said body and having an outlet having an axis directed substantially at right angles to said inner surface of said body to direct a jet of fuel thereagainst.

8. A device for atomizing liquid fuel in a gas turbine having a hollow rotary shaft having an axial path for fuel and a sidewall pierced therethrough with a hole having an axis directed substantially perpendicularly to said axial path, said hole defining a fuel injection nozzle, said atomizing device comprising:

a hollow cylindrical atomizing member secured at one end to said rotary shaft coaxially therewith for rotation about its own axis, said one end having means for securing said atomizing member to said rotary shaft, said atomizing member having a circular cylindrical inner surface coaxially encircling said rotary shaft and extending between said securing means and another end of said atomizing member which is open and defines an outlet for said atomizing member, said atomizing member being provided with a plurality of arcuate rims radially inwardly projecting from said other end thereof, said rims being circumferentially equally spaced apart from one another to define an arcuate recess between each adjoining pair of said rims, said recesses defining paths on said circular cylindrical inner surface for a spray of fuel leaving said inner surface centrifugally during the rotation of said atomizing member;

said nozzle facing said inner surface of said atomizing member and said axis thereof being directed substantially at right angles to said inner surface to direct a jet of fuel thereagainst.

* * * * *